US006671643B2

(12) United States Patent
Kachler et al.

(10) Patent No.: US 6,671,643 B2
(45) Date of Patent: Dec. 30, 2003

(54) METHOD FOR TESTING A HEARING AID, AND HEARING AID OPERABLE ACCORDING TO THE METHOD

(75) Inventors: Manfred Kachler, Nuremberg (DE); Fred Zoels, Altenthann (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 71 days.

(21) Appl. No.: 09/954,876

(22) Filed: Sep. 18, 2001

(65) Prior Publication Data

US 2002/0082794 A1 Jun. 27, 2002

(30) Foreign Application Priority Data

Sep. 18, 2000 (DE) ..... 100 46 098

(51) Int. Cl.[7] ..... H04R 29/00

(52) U.S. Cl. ..... 702/116; 702/103; 702/104; 381/61

(58) Field of Search ..... 702/116, 103, 702/104; 381/60, 320, 312, 321

(56) References Cited

U.S. PATENT DOCUMENTS 4,548,082 A * 10/1985 Engebretson et al. ..... 73/585
4,674,123 A * 6/1987 Michas ..... 381/60
4,992,966 A * 2/1991 Widin et al. ..... 702/103
5,027,410 A * 6/1991 Williamson et al. ..... 381/320
5,120,803 A * 6/1992 Kitahara et al. ..... 525/476
6,118,877 A 9/2000 Lindemann et al.
6,134,329 A * 10/2000 Gao et al. ..... 381/60

OTHER PUBLICATIONS

"New Developments in Hearing Instrument, . . . " Dyrlund, Recent Developments in Hearing Instrument Technology, 15th Danavox Symposium, 1993, pp. 408–413.

* cited by examiner

*Primary Examiner*—John Barlow
*Assistant Examiner*—Hien Vo
(74) *Attorney, Agent, or Firm*—Schiff Hardin & Waite

(57) ABSTRACT

In order to test a hearing aid having at least one microphone, one signal processing unit and one sound transducer, a sound channel is produced between the microphone and the sound transducer. The electrical signal path in the hearing aid is interrupted, and a test signal is fed into the interrupted signal path within the hearing aid, is emitted via the sound transducer, and is passed on through the sound channel to the microphone. The signal received by the microphone is then evaluated.

21 Claims, 2 Drawing Sheets

METHOD FOR TESTING A HEARING AID, AND HEARING AID OPERABLE ACCORDING TO THE METHOD

BACKGROUND OF THE INVENTION

1. Field of the Invention

The invention relates to a method for testing a hearing aid, and to a hearing aid which has at least one microphone, one signal processing unit and one sound transducer.

2. Description of the Prior Art

It is known for hearing aids to be placed in a test box or a test room for technical testing. The test box or test room have good sound attenuation, which means that their interior offers effective protection against interference noise from the exterior. In order to avoid corrupting the test results, the acoustic conditions in the interior of the test box or the test room also must be virtually ideal. The walls of the test box or the test room thus are designed such that virtually no acoustic reflections occur at their surface. At least one speaker is located in the text box or the test room in order to direct sound at a hearing aid to be tested. In order to measure the actual level of a test signal which is introduced via the speaker, there is also at least one reference microphone within the test box or the test room. For testing, sound is directed at the hearing aid in the test box or in the test room, and the signal received by the microphone is read out and evaluated at a specific point in the signal path within the hearing aid, which starts from the microphone and runs via the signal processing unit to the sound transducer.

The test signals are stored on a data storage medium, for example a CD, or are generated by a computer including various parameters, for example in order to define the dynamic response or frequency range.

Such known test facilities have the disadvantage that they are complex, expensive and complicated to handle. They are therefore normally used only by hearing aid manufacturers or test laboratories.

SUMMARY OF THE INVENTION

An object of the present invention is to provide a method which simplifies testing of a hearing aid, and a hearing aid which can be tested more easily.

The invention is universally applicable to hearing aids. The hearing aid may in this case be a hearing aid that is worn behind the ear, a hearing aid that is worn in the ear or a pocket hearing aid. The signal processing may be carried out in analog or digital form. Furthermore, the hearing aid may have a single microphone or a multiple microphone system.

In the method according to the invention, a sound channel with a defined transmission response is first produced between the sound transducer and at least one microphone in the hearing aid. In the case of a behind the ear hearing aid, for example, this may be done by fitting a sound loop which leads from the sound transducer to the microphone. Open transmission of the sound originating from the sound transducer through the air surrounding the hearing aid to the microphone is pointless for testing, since this would result in too many incalculable interference influences. The transmission response of a closed sound channel between the sound transducer and the microphone is, in contrast, known, and can be taken into account in the evaluation.

An alternative option to fitting an external sound loop is to provide a corresponding sound channel for connecting the sound transducer to the microphone within the housing or on the housing at the manufacturing stage. In order to avoid feedback, this sound channel is preferably closed during normal operation of the hearing aid, and is opened only during testing. In this case, the hearing aid may have flaps or valves which can be operated manually or automatically in order to open or close the sound channel.

In a further method step, the normal signal path within the hearing aid, which runs from the microphone via the signal processing unit to the sound transducer, is interrupted. A test signal is then fed into the interrupted signal path. The test signal is then emitted either directly, or possibly after further processing, for example filtering or amplification, via the sound transducer of the hearing aid. It is passed via the sound channel to the microphone of the hearing aid, by which it is received for further processing and evaluation.

The method for testing a hearing aid according to the invention thus does not require either a test room or a test box. It can be carried out with simple means and without any complex test facilities. A largely automatic procedure can also be used for the test method, so that even the person using the hearing aid can test it without any specific specialist knowledge. In this case, it is possible to test virtually all the functions and characteristics of the hearing aid which can also be tested using a test box or test room. This includes, for example, the frequency response, or the response to different stimuli. There is no need for any reference microphone, as is normally used in a test box or a test room.

In order to take account of the change to the transmission response when the hearing aid is being worn, a variant of the method allows a coupler to be introduced into the sound channel between the sound transducer and the microphone. This coupler has an enclosed air volume of approximately 2 $cm^3$, for example in order to simulate an average hearing response.

The method for testing a hearing aid becomes particularly simple and cost-effective if the test signal is stored in the hearing aid, or is generated in the hearing aid. If, furthermore, the signal received by the microphone likewise can be evaluated in the hearing aid, then a simple test of the hearing aid can be carried out without the assistance of any external test facilities. A hearing aid test thus can be carried out virtually at any time and anywhere.

To provide a conclusion as to the result of the test, the hearing aid emits a monitoring signal. The monitoring signal may be produced in audible form, for example by emitting specific tones or tone combinations which allow a conclusion about the result of the test, or by optical indication means on the hearing aid, for example in the form of an LCD or LED indication.

In order to obtain a detailed conclusion about the functionality of the hearing aid, it is connected, according to a further variant of the method, to an external test set for testing. The test set may be a standard computer in which specific test software is run in order to test the hearing aid. Test signals which are generated in the test set or are stored in it are transmitted from the test set to the hearing aid. The signals which are then, according to the invention, received by the microphone of the hearing aid, are subsequently transmitted back from the hearing aid to the test set. This variant allows considerably more comprehensive test and evaluation functions to be carried out than those which are feasible with the "self-test" described above, without any external test equipment. Due to the widespread use of computers and their simple and standardized handling, this method variant nevertheless offers advantages over known test methods, in which further, specific and expensive test facilities (test box, etc.) are required.

In order to test the hearing aid, it can be connected via a cable to a test set which, for example makes contact with the programming socket of the hearing aid and with a corresponding interface on the test set. There is thus no need for any additional interface on the hearing aid. Wireless communication between the hearing aid and the test set is also possible. For this purpose, both the hearing aid and the test set are provided with appropriate transmitting and receiving units.

Depending on the components of the hearing aid which are to be tested, the test signal can be fed in at different points in the signal path in the hearing aid. For example, in order to check the sound transducer and the microphone, the test signal can be fed directly into the signal path upstream of the sound transducer, and can be tapped and evaluated directly downstream from the microphone. All the signal processing circuitry thus is excluded from this test. The test signal may, however, entirely or partially pass through the signal processing unit, before being emitted via the sound transducer or before being tapped off in the signal path in the hearing aid. All the signal processing circuitry, or at least components of the signal processing circuitry, is then included in the test as well. This has the advantage of allowing a large number of adjustment options offered by modern signal processing units to be included in the test. In addition, faults within the signal processing unit can be traced and thus localized exactly by expedient choice of the points at which the test signal is fed into the signal path in the hearing aid and at which the signal received by the microphone is tapped.

DESCRIPTION OF THE PREFERRED EMBODIMENTS

Figure 1:
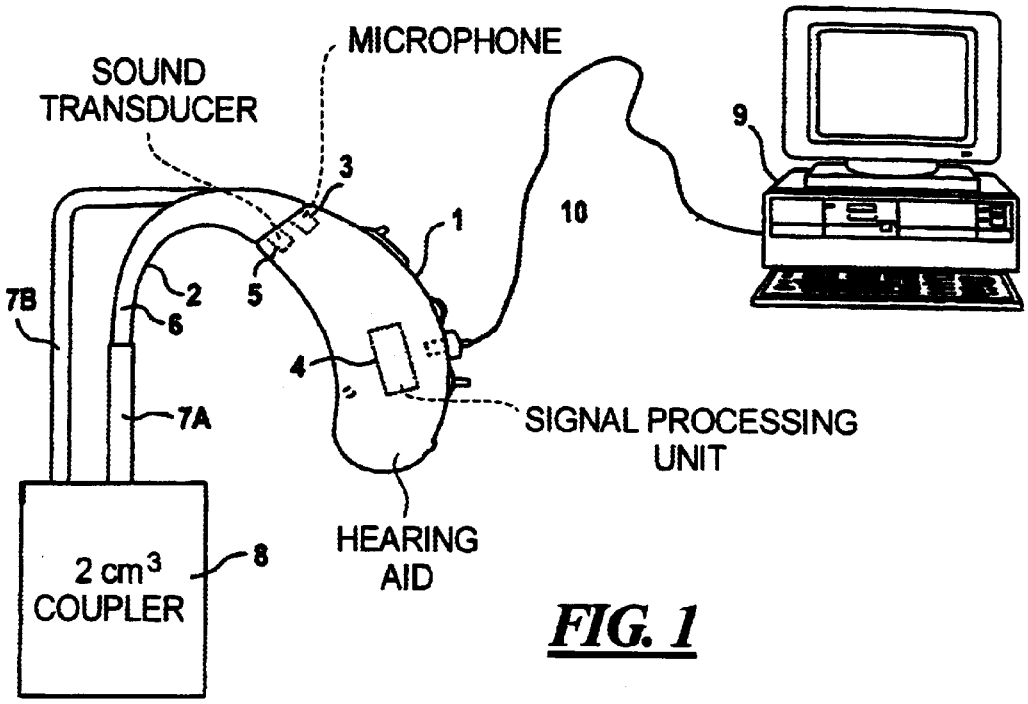
FIG. 1 shows a hearing aid which can be worn behind the ear and which has a closed sound channel between the microphone and the sound transducer for testing in accordance with the invention.

FIG. 1 shows a hearing aid 1 which can be worn behind the ear and has a hook 2 to go over the ear. An acoustic signal is received via the microphone 3 and is converted into an electrical signal, which is passed on to the signal processing unit 4 for further processing. The electrical signal is converted back into an acoustic signal in a sound transducer 5 and, during normal operation of the hearing aid, is supplied to the ear of someone wearing the hearing aid via the hook 2 which goes over the ear and through which a sound channel 6 passes, in order to carry the sound.

In order to test the hearing aid 1, it is connected to components of a test facility. This includes sound loops 7A and 7B, a 2 $cm^3$ coupler 8, an external test set 9 and a connecting cable 10 between the hearing aid 1 and the test set 9. Test signals generated by the test set 9, which in the exemplary embodiment is in the form of a commercially available PC in conjunction with specific test software, are transmitted to the hearing aid via the connecting cable 10. In order to avoid feedback, the normal signal path within the hearing aid, starting from the microphone 3 via the signal processing unit 4 to the sound transducer 5, is interrupted during the test. At least one switch is provided (see FIG. 2) for this purpose in the signal path in the hearing aid 1, and this switch is opened when the test set 9 is connected. The test signal supplied from the test set 9 is now fed into the signal path downstream of the interruption point, passes through the rest of the signal path, and is emitted via the sound transducer 5. The sound signal is passed on to the 2 $cm^3$ coupler 8 through the sound channel 6 and through the sound loop 7A connected to it. This coupler 8 is used to simulate the hearing response of the hearing aid 1 when worn behind the ear. The ends of the sound loop 7B are connected to the output of the coupler 8, and to the input of the microphone 3. The sound is thus passed on from the coupler 8 to the microphone 3. The signal received by the microphone 3 is then tapped off upstream of the switch in the signal path of the hearing aid 1 (see FIG. 2), and is transmitted via the connecting cable 10 to the test set 9. The transmitted and received signals can then be compared in order to determine the transmission response of the hearing aid 1, or of components of the hearing aid 1.

Figure 2:
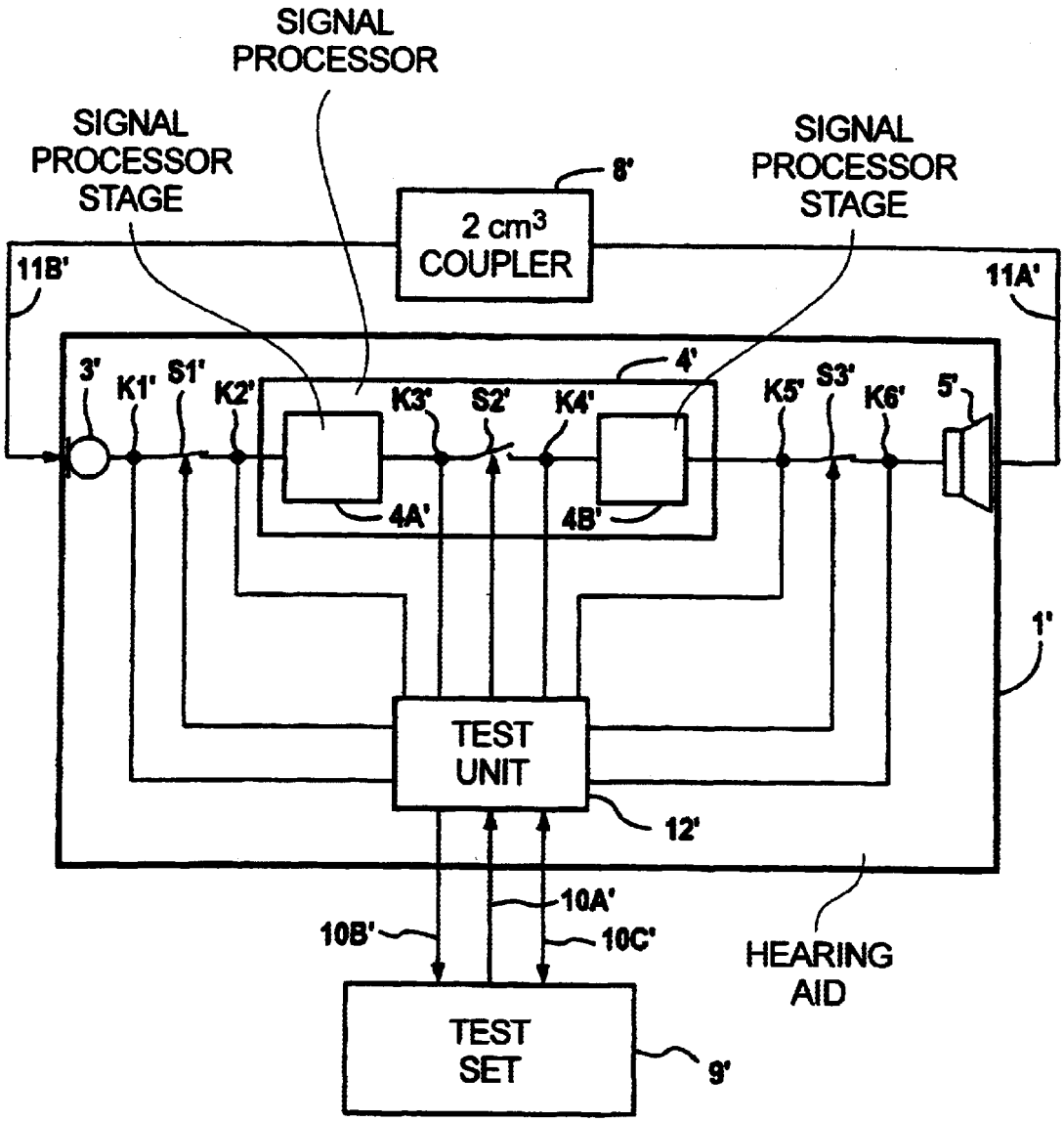
FIG. 2 shows, schematically, a further embodiment of test arrangement for a hearing aid in accordance with the invention.

FIG. 2 shows the circuit diagram of a test arrangement according to FIG. 1, illustrated schematically. A hearing aid 1' with a microphone 3', a signal processing unit 4' and a sound transducer 5' has a test unit 12' in order to carry out a test. During the test, the test unit 12' is connected to the external test set 9' via the signal lines 10A' and 10B', and the control line 10C'. Furthermore, the test unit 12' is connected to three programmable switches S1', S2', S3' and to contact points K1' to K6'. In this case, the switch S1' is arranged between the microphone 3' and the signal processing unit 4', the switch S2' is located between the stages 4A' and 4B' within the signal processing unit, and the switch S3' is located in the signal path between the signal processing unit 4' and the sound transducer 5'. The contact points K1' to K6' are respectively located upstream or downstream of one of the three switches. Test signals can both be fed into and read from the signal path of the hearing aid 1' at all the contact points. The test set 9' is used to determine which of the three switches S1', S2', S3' is or are opened during the test.

The test set 9' furthermore determines which of the contact points K1' to K6' is used to feed a test signal into, or read it from, the signal path in the hearing aid 1'. In this case, the test signal is fed in or read out via the signal lines 10A' and 10B', and the test unit 12' is controlled by the control line 10C', in particular for opening the switches and for connection to individual contact points.

In the exemplary embodiment, the signal path between the signal processor stages 4A' and 4B' in the signal processing unit 4' is disconnected by the opened switch S2'. The stage 4A' may, for example, include one or more of an A/D converter, a preamplifier unit, and a filter. The stage 4B' can include, for example, a filter and/or an output amplifier. The test set 9' generates test signals, which are transmitted via the signal line 10A' to the hearing aid 1' and, for example, are fed into the signal path in the hearing aid 1' at the contact point K4' upstream of the stage 4B' in the signal processing unit 4'. The test signal thus passes through the component 4B' in the signal processing unit 4', and is converted from an electrical signal to an acoustic signal by means of the sound transducer 5'. The acoustic signal is supplied via the sound channel 11A' to a 2 $cm^3$ coupler 8', from whose output it passes via the sound channel 11B' to the microphone 3' of the hearing aid 1', where the acoustic signal is converted into an electrical signal, which then passes through the stage 4A' in the signal processing unit 4'. At the output of the stage 4A', the test signal is read out via the contact point K3', and is transmitted back via the signal line 10B' to the test set 9'. The transmitted test signal can be compared with the signal received by the microphone 3' in order to determine the transmission response of the hearing aid 1' in the configuration as shown as an example, and thus to check the serviceability of the hearing aid.

In contrast to the described exemplary embodiment, the test unit 12' may be omitted, for example if the hearing aid, as shown in FIG. 1, is connected to an external test set via a connecting cable for testing. Then, in an embodiment of the invention which is simple to implement, the switch S2' can be opened mechanically when a connecting plug is inserted into the hearing aid, and contact can be made with the contact points K3' and K4' in order to feed in and read out a test signal. In this case, however, the hearing aid does not have the capability to select between different points in the signal path for feeding the test signal in or reading it out.

Furthermore, in another embodiment (not illustrated), the signal lines 10A', 10B' and the control line 10C' can be replaced by wireless signal paths. Both the hearing aid and the test set then have means for transmitting and receiving the test signal and control signals.

Figure 3:
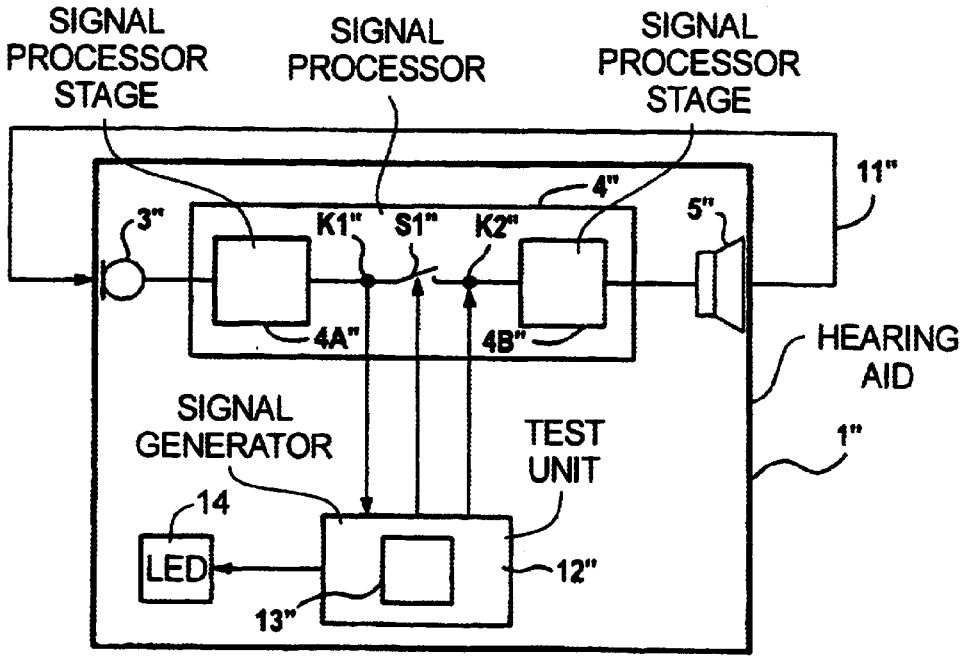
FIG. 3 shows a circuit arrangement for carrying out a hearing aid self-test in accordance with the invention.

The circuit arrangement as illustrated in FIG. 3 for carrying out the self-test results in a simplification to the test arrangement shown in FIGS. 1 and 2. In contrast to FIG. 1, neither the connecting cable 10 nor the external test set 9 are required for the self-test. In order to produce a test signal, the hearing aid 1" has a signal generator 13', which is connected to the signal processing unit 4" via the test unit 12". For testing, the hearing aid is switched to a test mode, for example by manual operation of a test switch fitted on the housing of the hearing aid, or by operation of a remote control. In the test mode, the switch S1" is opened in order to interrupt the signal path, and the test signal produced by the signal generator 13" is fed into the signal path at the contact point K2". The test signal thus passes through the stage 4B" in the signal processing unit 4", and is converted by the sound transducer 5" from an electrical signal into an acoustic signal. The acoustic signal is passed directly via the sound channel 11" to the microphone 3" of the hearing aid 1", where it is converted into an electrical signal which then passes through the stage 4A" in the signal processing unit 4". At the output of the stage 4A", the test signal is read out via the contact point K1", and is transmitted back to the test unit 12" via a signal line. The transmitted test signal can be compared with the signal received by the microphone 3' in order to determine the transmission response of the hearing aid 1" in the configuration shown as an example, and thus check the serviceability of the hearing aid. A successful self-test is acknowledged by the hearing aid 1" by means for indicating the result of the test in the form of a green light-emitting diode 14".

Although modifications and changes may be suggested by those skilled in the art, it is the intention of the inventor to embody within the patent warranted hereon all changes and modifications as reasonably and properly come within the scope of his contribution to the art.

We claim as our invention:

1. A method for testing a hearing aid, said hearing aid having a microphone, a signal processing unit and an acoustic output transducer, and a signal path proceeding through said signal processing unit between said microphone and said output transducer, said method comprising the steps of:

providing a sound channel having a defined acoustic transmission response between said output transducer and said microphone;

interrupting said signal path;

introducing an electrical test signal into the interrupted signal path;

emitting said test signal from said output transducer, as an acoustic tests signal, through said sound channel to said microphone;

picking up said acoustic test signal with said microphone and, in said microphone, generating a microphone signal corresponding to said acoustic test signal; and evaluating said microphone signal.

2. A method as claimed in claim 1 comprising the additional step of acoustically connecting a coupler, which acoustically simulates a human ear, into said sound channel between said output transducer and said microphone.

3. A method as claimed in claim 1 wherein the step of introducing said test signal into the interrupted signal path comprises providing a test signal source in said hearing aid and supplying said test signal from said test signal source to said interrupted signal path in said hearing aid.

4. A method as claimed in claim 3 comprising storing said test signal in said test signal source.

5. A method as claimed in claim 3 comprising generating said test signal in said test signal source.

6. A method as claimed in claim 1 comprising the additional step of, after evaluating said microphone signal, generating a humanly perceptible signal indicating a result of evaluating said microphone signal.

7. A method as claimed in claim 1 wherein the step of evaluating said microphone signal comprises placing an external test set in communication with said hearing aid, and supplying said microphone signal to said external test set and evaluating said microphone signal in said external test set.

8. A method as claimed in claim 7 comprising generating said test signal in said test set and supplying said test signal from said test set to said hearing aid.

9. A method as claimed in claim 7 comprising communicating between said test set and said hearing aid by providing a wired connection between said external test set and said hearing aid.

10. A method as claimed in claim 7 comprising wirelessly communicating between said external test set and said hearing aid.

11. A method as claimed in claim 1 wherein the step of introducing said test signal into said interrupted signal path comprises introducing said test signal into said interrupted signal path at a location between said signal processing unit and said output transducer.

12. A method as claimed in claim 1 wherein the step of introducing said test signal into said interrupted signal path comprises introducing said test signal into said interrupted signal path at a location so that said test signal at least partially proceeds through said signal processing unit.

13. A method as claimed in claim 12 comprising tapping said microphone signal for evaluation at a location in said signal path after said microphone signal has at least partially past through said signal processing unit.

14. A method as claimed in claim 1 comprising tapping said microphone signal for evaluation at a location in said signal path before said microphone signal proceeds through said signal processing unit.

15. A hearing aid test arrangement comprising:

a hearing aid having a microphone and an acoustic output transducer with a signal path therebetween containing a signal processing unit;

a closed sound channel temporarily acoustically connectable between said output transducer and said microphone;

at least one switch in said signal path activatable for temporarily interrupting said signal path;

a test signal source for introducing an electrical test signal into said interrupted signal path, said test signal resulting in emission of an acoustic output signal from said output transducer, which is communicated to said microphone via said closed sound channel, and which results in generation of a microphone signal in said microphone; and an evaluation unit for evaluating said microphone signal.

16. A hearing aid test arrangement as claimed in claim 15 wherein said hearing aid has a hearing aid housing, and wherein said signal source is disposed in said hearing aid housing.

17. A hearing aid test arrangement as claimed in claim 15 comprising a test kit in communication with said hearing aid, said test kit containing said test signal source and said evaluation unit for evaluating said microphone signal.

18. A hearing aid test arrangement as claimed in claim 17 comprising a cable electrically connecting said test kit and said hearing aid.

19. A hearing aid test arrangement as claimed in claim 17 comprising a wireless communication system allowing wireless communication between said test kit and said hearing aid.

20. A hearing aid test arrangement as claimed in claim 15 further comprising a signal generator, connected to said evaluation unit, for generating a humanly perceptible signal indicating a result of evaluation of said microphone signal.

21. A hearing aid test arrangement as claimed in claim 15 wherein said closed sound channel includes a coupler which acoustically simulates a human ear.

* * * * *